United States Patent [19]

Wakui et al.

[11] Patent Number: 4,783,378

[45] Date of Patent: Nov. 8, 1988

[54] STEEL SHEETS FOR DRAWING AND IRONING WORKED CANS

[75] Inventors: Tsuneyoshi Wakui; Takeo Ohnishi; Yuji Shimoyama; Toshio Akizuki, all of Chiba, Japan

[73] Assignee: Kawasaki Steel Corporation, Kobe, Japan

[21] Appl. No.: 65,561

[22] Filed: Jun. 23, 1987

[30] Foreign Application Priority Data

Jun. 30, 1986 [JP] Japan ..... 61-153287

[51] Int. Cl.[4] ..... B21D 53/00

[52] U.S. Cl. ..... 428/600; 428/687; 428/925

[58] Field of Search ..... 428/687, 600, 601, 684, 428/679, 923, 925; 29/121.1, 121.8; 72/199

[56] References Cited

U.S. PATENT DOCUMENTS

| | | | |
|---|---|---|---|
| 413,374 | 10/1889 | Paull | 428/600 |
| 2,991,544 | 7/1961 | Gotsch et al. | 428/687 |
| 3,619,881 | 11/1971 | Bills et al. | 428/600 |
| 3,623,850 | 11/1971 | Horvath | 428/687 |
| 4,071,657 | 1/1978 | Rault | 428/601 |
| 4,200,382 | 4/1980 | Friedman | 29/121.1 |
| 4,679,288 | 7/1987 | Monfort et al. | 29/121.1 |

FOREIGN PATENT DOCUMENTS

| | | | |
|---|---|---|---|
| 157754 | 10/1985 | European Pat. Off. | 29/121.8 |
| 8330 | 4/1979 | Japan | 428/687 |
| 30485 | 7/1984 | Japan | 29/121.1 |
| 1045641 | 10/1966 | United Kingdom . | |
| 2040824A | 9/1980 | United Kingdom | 219/121 LM |
| 2069906A | 9/1981 | United Kingdom | 219/121 LM |

OTHER PUBLICATIONS

Cahiers D'Informations Techniques de la Revue de Metallurgie vol. 80, No. 5, May 1983, pp. 393–401, Paris, Fr., J. Crahay, et al.; "Gravure de la Rugosite des Cylindres de Laminoir par Impulsions Laser".

*Primary Examiner*—John J. Zimmerman

*Attorney, Agent, or Firm*—Balogh, Osann, Kramer, Dvorak, Genova & Traub

[57] ABSTRACT

A steel sheet for DI can having improved DI workability and resistance to die abrasion has such a surface profile that a center-line average surface roughness is within a range of 0.1~4.0 μm and a microscopic shape is comprised of mountain portions, groove-like valley portions and middle flat portions satisfying particular dimension relations.

1 Claim, 8 Drawing Sheets

STEEL SHEETS FOR DRAWING AND IRONING WORKED CANS

BACKGROUND OF THE INVENTION

1. Field of the Invention

This invention relates to steel sheets for DI (drawing and ironing worked) cans, and more particularly to tinned steel sheets for DI cans having improved DI workability, resistance to die abrasion and corrosion resistance.

Throughout the specification, the term "steel sheet" means a blackplate before plating or removing a plated layer after the plating, and the term "plated steel sheet" means a sheet obtained by plating the blackplate, and the term "DI can" means a two-piece can obtained by subjecting the steel sheet or plated steel sheet to drawing and ironing, and the term "DI work" means a working for forming the two-piece can by drawing and ironing, and the term "DI workability" means an easiness of DI work.

2. Related Art Statement

DI cans are used for filling carbonated beverage or other beverage. In turn, the plated steel sheet used for DI cans is produced by annealing a steel sheet after cold rolling, subjecting the annealed sheet to temper rolling through dull roll and then subjecting it to plating.

The tinning not only gives the corrosion resistance to the steel sheet but also serves as a lubricant in the DI work. Lately, the reduction of tinning amount is promoted for reducing the cost in the manufacture of DI cans.

In the plated steel sheet for DI can, it is required to have excellent DI workability and corrosion resistance and to reduce die abrasion, which are degraded as the tinning amount becomes small. That is, the reduction of tinning amount lowers the lubricating function to degrade the DI workability, and consequently the die life becomes short and the corrosion resistance is naturally degraded.

In order to solve these problems, there are proposed some methods. For instance, a method of producing plated steel sheets for DI cans by subjecting a steel sheet to temper rolling through dull rolls worked by discharge working or shot blast process and then tinning it is proposed in Japanese Patent laid open No. 54-150,331. This article discloses that when the surface roughness of the dull roll is less than 1.50 μm, the shortage of tinning amount is caused during DI work to degrade the lubricating function, while when it exceeds 3.50 μm, the working energy reduces but the appearance at the bottom of the DI can and the rust prevention are degraded. Further, the article discloses that when the cut-off level of the surface roughness is less than 1.20 μm, the adhesion force of tin becomes small to lower the lubricating function, while when it exceeds 1.30 μm, the adhesion force is certainly enhanced but the enhancing effect is undesirably small from a viewpoint of economical reason. And also, it discloses that when PPI (peak per inch) of the surface roughness is less than 200, the sectional area per peak becomes large and hence the hardening due to the ironing becomes conspicuous and the working energy unfavorably increases.

From the above facts, it is obvious that when the dull roll satisfies a surface roughness of 1.50~3.50 μm, a cut-off level of 1.20~1.30 μm and PPI of not less than 200, the resulting plated steel sheet for DI can has improved DI workability and die life.

Further, Japanese Patent laid open No. 55-158,838 discloses that the die life and stripping-out property are improved by limiting a surface roughness of a plated steel sheet for DI can to not more than of 20μ in (RMS) and applying an oil with a friction coefficient of not more than 0.12 to the sheet because as the surface roughness of the plated steel sheet becomes small, the tin covered ratio becomes large and the die abrasion reduces, while as the surface roughness becomes large, the stripping-out property is improved.

On the other hand, Japanese Patent laid open No. 55-50,485 discloses that as the surface roughness becomes large, the DI workability is improved but iron is exposed on the mountain portions of the plated steel sheet during DI work to degrade the corrosion resistance. In this article, therefore, the surface roughness (Ra) of blackplate (steel sheet) is restricted to Ra≦0.4 μm and a ratio of PPI at a preset level of 2 μm to PPI at a preset level of 0.25 μm is limited to not more than 0.05, whereby the above problem is solved.

As apparent from the above, these conventional methods are not a technique simultaneously satisfying all properties such as DI workability, resistance to die abrasion, corrosion resistance and so on. That is, if it is intended to simultaneously establish all properties by anyone of the conventional methods, the conflicting phenomenon is caused as follows.

As the surface roughness becomes small, since the mountain portion is small, the exposure of iron (blackplate) at the mountain portion in the DI work is prevented to improve the corrosion resistance and also the tin covered ratio increases to reduce the die abrasion, but the abraded tin powder produced in the working is caught in a contact face between the die (and/or punch) and the plated steel sheet to cause the galling because the abraded powder can not get away to the valley portions to degrade the trapping property. For this reason, the scuffing and baking are caused in the plated steel sheet to.degrade the quality and workability.

On the contrary, as the surface roughness becomes large, the working energy reduces to improve the DI workability and stripping-out property, but the tin covered ratio reduces to increase the die abrasion and the corrosion resistance is degraded due to the exposure of iron. When the surface roughness is too large, the degradation of appearance at the can bottom is caused in addition to the above problem.

SUMMARY OF THE INVENTION

It is, therefore, an object of the invention to solve the above problems causing the conflicting phenomenon and to provide steel sheets for DI cans having improved DI workability, resistance to die abrasion and corrosion resistance.

In order to achieve the above object and other objects, the steel sheet for DI can according to the invention satisfies the following requirements (i)~(iii):

(i) a center-line average surface roughness Ra is within a range of 0.1~4.0 μm;

(ii) a microscopic shape constituting the surface roughness is comprised of (a) trapezoidal mountain portions having a flat top surface, (b) groove-like valley portions formed so as to surround a whole or a part of the mountain portion, and (c) middle flat portions formed between the mountain portions outside the valley portion so as to be higher than the bottom of the valley portion and lower than or equal to the top surface of the mountain portion; and (iii) the following relation are satisfied:

$$1.0 \leqq Sm/D \leqq 1.7$$

$$30\ \mu m \leqq d \leqq 500\ \mu m$$

, wherein Sm is a mean center distance between the adjoining mountain portions, D is a mean diameter in the outer periphery of the valley portion and d is a mean diameter in the flat top surface of the mountain portion.

BRIEF DESCRIPTION OF THE DRAWINGS

The invention will be described with reference to the accompanying drawings, wherein.

DESCRIPTION OF THE PREFERRED EMBODIMENTS

According to the invention, the steel sheet for DI can is subjected to a temper rolling with work roll dulled through a high density energy source such as a laser beam or the like, whereby the top surface of mountain portion constituting the surface roughness is made flat and many middle flat portions are formed between the mounting portions. Thus, the surface of the dulled steel sheet is superior in ever aspect to the irregular rough surfaces dulled through the conventional shot blast process and discharge working process even if the sheet is subjected to tinning and DI work as mentioned below.

That is, even when the surface roughness is large, since many flat portions rre present in the steel sheet, the tin covered ratio in the plated steel sheet is high to reduce the die abrasion. And also, the top surface of the mountain portion is flat, so that the degradation of corrosion resistance due to iron exposure is not caused and the DI workability is satisfactory. On the other hand, even when the surface roughness is small, since the groove-like valley portions and middle flat portions are existent in the steel sheet, the trapping property for tin abraded powder is good. Further, when the roughness becomes larger, since many flat portions are existent in the steel sheet, the resulting plated steel sheet is less in the irregular reflection of light as compared with the plated steel sheets after the temper rolling with work roll dulled through the conventional shot blast process and discharge working process, and the appearance at the can bottom is good.

The invention will be described in more detail below.

[1] Dulling of work roll used for the manufacture of steel sheet for DI can according to the invention At first, the invention will be described with respect to a means for dulling the work roll, which is a pre-stage in the temper rolling of the steel sheet for DI can according to the invention. The dulled work roll is a roll used for temper rolling a steel sheet to form the steel sheet for DI can according to the invention.

A work roll for temper rolling is dulled through a high density energy source, e.g. a laser as follows.

Figure 1:
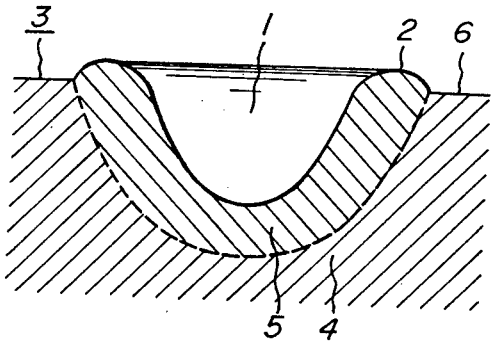
FIG. 1 is a partially enlarged section view of the work roll used for temper rolling the steel sheet for DI can according to the invention.

A laser pulse is projected onto the surface of the rotating work roll in sequence to regularly fuse surface portions of the roll exposed to a laser energy, whereby crater-like concave portions are regularly formed on the roll surface. FIG. 1 sectionally shows a part of the dulled roll surface, wherein numeral 1 is a crater-like concave portion (hereinafter referred to as a crater simply) formed on a surface of a work roll 3. The fused base metal of the roll upheaves upward from the surface level of the roll 3 in the form of ring around the crater 1 to form a flange-like upheaved portion 2 (hereinafter referred to as a flange simply). Moreover, the inner wall layer of the crater 1 inclusive of the flange 2 is a heat-affected zone to a base metal structure 4 of the roll.

Figure 2:
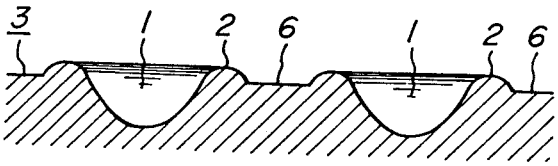
FIG. 2 is a schematically sectional view of a surface roughness profile of the work roll of FIG. 1.
Figure 3:
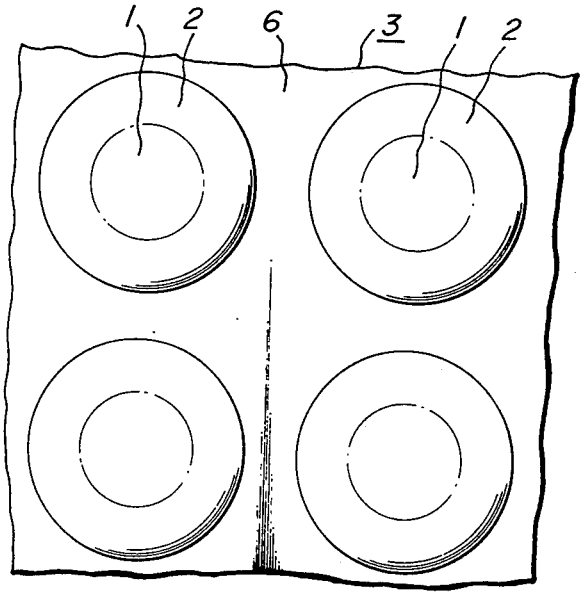
FIG. 3 is a plan view of FIG. 2.

The rough state on the surface of the dulled work roll 3 is shown in FIGS. 2 and 3. As seen from FIGS. 2 and 3, a portion located between the adjacent craters 1 outside the flange 2 is a flat surface 6 corresponding to the original roll surface. Moreover, the mutual distance between the adjacent craters 1 can be adjusted by controlling the frequency of laser pulse in relation to the rotating speed of the roll 3 in the rotating direction of the roll 3 and by controlling the pitch of moving the irradiation position of the laser in the axial direction of the roll 3 every one rotation.

Although the invention has been described with respect to the use of laser as a high density energy source, similar results are obtained when using a plasma or an electron beam as a high density energy source.

In this embodiment, the work roll is dulled by using the high density energy source. Moreover, the work roll having the craters 1, flanges 2 and flat portions 6 as mentioned above may be formed by the other method. That is, the steel sheet for DI can according to the invention is characteristic of the roughened surface itself as defined above and is not characteristic of method for forming the dulled work roll giving the roughened surface to the steel sheet.

[2] Formation of steel sheet for DI can by temper rolling steel sheet with the dulled work roll to transfer dull pattern to steel sheet A steel sheet (e.g. a cold rolled steel sheet after annealing or the like) is rolled at a light draft at the temper rolling step using the dulled work roll as mentioned above, whereby the dull pattern formed on the surface of the work roll is transferred to the surface of the steel sheet to thereby give a rough surface to the steel sheet.

Figure 4:
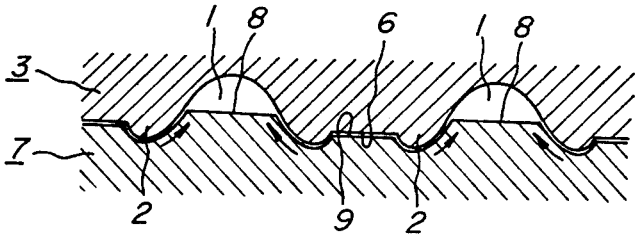
FIG. 4 is a diagrammatically section view showing a state of subjecting the steel sheet for DI can to a temper rolling with the work roll shown in FIGS. 1–3.

When microscopically observing the steel sheet surface at the temper rolling step, as shown in FIG. 4, the flanges 2 having substantially a uniform height around the crater 1 on the surface of the roll 3 is pushed to the surface of the steel sheet 7 under a strong pressure, whereby the local plastic flow of material is caused near the surface of the steel sheet 7 softer than the material of the roll 3 and consequently metal of the steel sheet 7 flows into the craters 1 of the roll 3 as shown by an arrow to render the steel sheet surface into a rough state.

Figure 5:
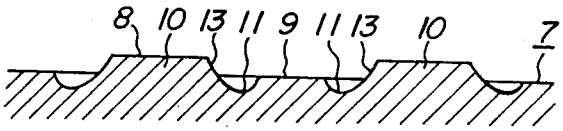
FIG. 5 is a schematically sectional view showing a surface roughness profile of the steel sheet for DI can after the temper rolling.
Figure 6:
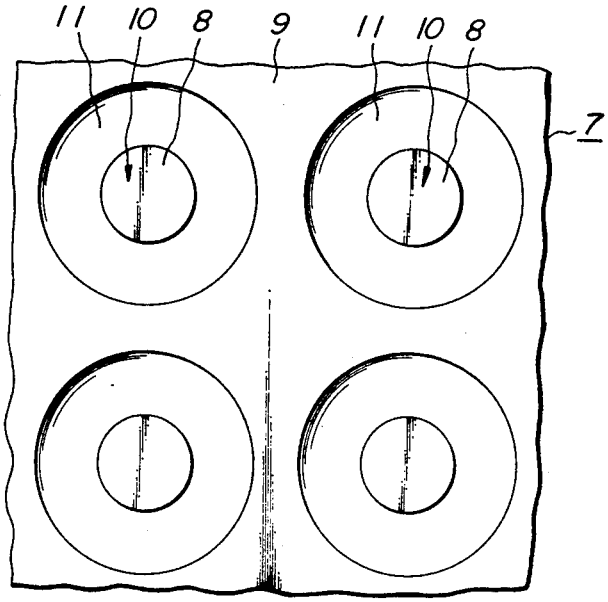
FIG. 6 is a plan view of FIG. 5.
Figure 7A:
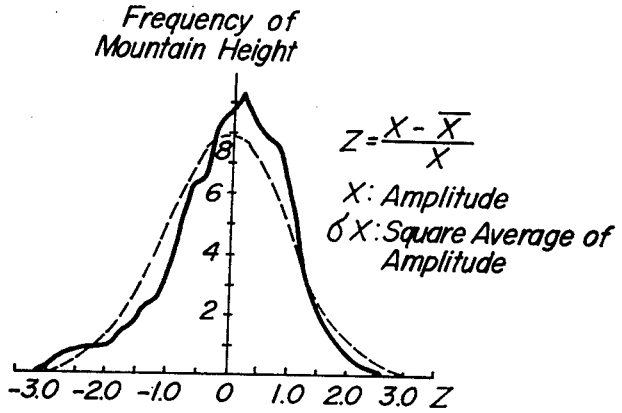
FIG 7a PRIOR ART
FIG. 7*a* is a graph showing a distribution of mountain height in the surface of the work roll dulled through the conventional shot blast process.
Figure 7B:
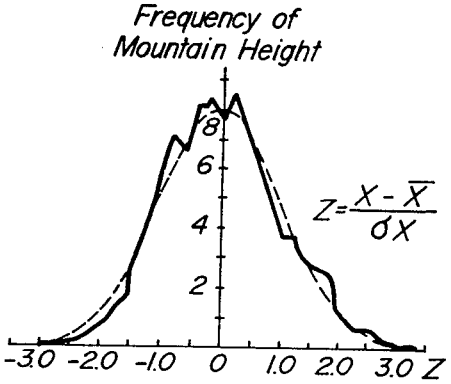
FIG 7b PRIOR ART
FIG. 7*b* is a graph showing a distribution of mountain height in the surface of the work roll dulled through the conventional discharge working process.

In this case, a top surface 8 of the upheaved steel sheet inside the crater 1 becomes flat likewise the original steel sheet surface, while that portion 9 of the steel sheet which is pushed by the flat portion 6 between the adjacent craters 1 outside the flange 2 in the roll 3 is flat as it is, and the former top surface 8 is higher than or equal to the latter flat surface 9. Therefore, as shown in FIGS. 5 and 6, the microscopic shape of surface roughness in the steel sheet 7 after the temper rolling is comprised of trapezoidal mountain portions 10 having a flat top surface 8, groove-like valley portions 11 formed so as to surround the mountain portions, and middle flat portions 9 formed between the adjoining mountain portions 10 outside the valley portion 11 so as to be higher than the bottom of the valley portion 11 and lower than or equal to the top surface of the mountain portion 10.

As seen from the above, the ratio of flat portions comprising the top surface 8 of the mountain portion 10 and the middle flat portion 9 becomes larger in the surface of steel sheet after the temper rolling, while the ratio of slope 13 between the mountain portion 10 and the valley portion 11 becomes principally small.

Figure 8:
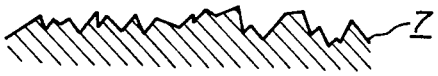
FIG 8 PRIOR ART
FIG. 8 is a schematically sectional view illustrating a surface profile of the steel sheet dulled by temper rolling with the work roll dulled through the conventional process.

On the other hand, in case of the work roll dulled through the shot blast process or the discharge working process, the roughness of the roll surface has various mountain heights similar to normal distribution as shown in FIG. *7a* or *7b*. Therefore, as shown in FIG. 8, the ratio of slopes between the mountain and the valley becomes principally larger in the steel sheet 7 after the temper rolling. Therefore, the structure and formation step of surface roughness profile by the conventional technique are entirely different from those in the steel sheet temper rolled with the work roll dulled through the laser process according to the invention.

In this embodiment, the shape of the valley portion 11 is continuous circle surrounding the mountain portion 10 but may be discontinuous arc.

[3] DI work after tinning of dulled steel sheet

Figure 9:
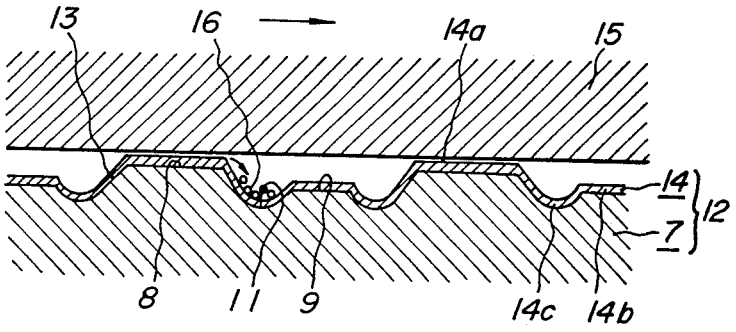
FIG. 9 is a diagrammatically section view illustrating a state that the tinned steel sheet for DI can according to the invention is subjected to a DI work.

The above dulled steel sheet for DI can is subjected to an electro-tinning and further to a DI work. This DI work is typically shown in FIG. 9, wherein a tinned layer 14 is formed on the surface of the dulled steel sheet 7 to provide a plated steel sheet 12 for DI can. The plated steel sheet 12 contains many flat portions as compared with the case using the shot blast process or discharge working process, so that the surface area per unit area of the steel sheet becomes small. Therefore, if the tinned amount is the same, the thickness of the tinned layer 14 in the plated steel sheet 12 according to the invention becomes thicker as compared with the conventional technique and the lubricating function in the DI work becomes higher.

In the electro-tinning, it is known that tin is much precipitated onto the mountain portion, at where the electric current becomes high. Therefore, the tinned layer 14 has the following relation:

$$\alpha \geqq \beta > \gamma$$

wherein $\alpha$ is a thickness of the tinned layer 14*a* at the top surface 8, $\beta$ is a thickness of the tinned layer 14*b* at the middle flat portion 9 and $\gamma$ is a thickness of the tinned layer 14*c* at the valley portion 11. That is, the thickness of the tinned layer 14*a* contacting with a die (or punch) 15 for DI work is thickest, so that the thickness distribution of the plated layer 14 according to the invention is further advantageous from a viewpoint of the lubricating function.

Furthermore, iron hardly exposes during DI work because the top surface 8 is flat, while the tin abraded powder 16 can sufficiently be trapped in the valley portion 11, so that the galling is never caused between the plated steel sheet 12 and the die 15. Moreover, the tinned layer 14 is thick, and the tin covered ratio is high, and the exposure of iron is not caused at the mountain portion, so that the corrosion resistance of the steel sheet 7 is more improved. Since many flat portions are existent in the steel sheet, the irregular reflection is very small as compared with the case using the work roll dulled through the shot blast process or discharge working process, so that there is caused no degradation of appearance at the can bottom corresponding to the unworked portion.

Figure 10:
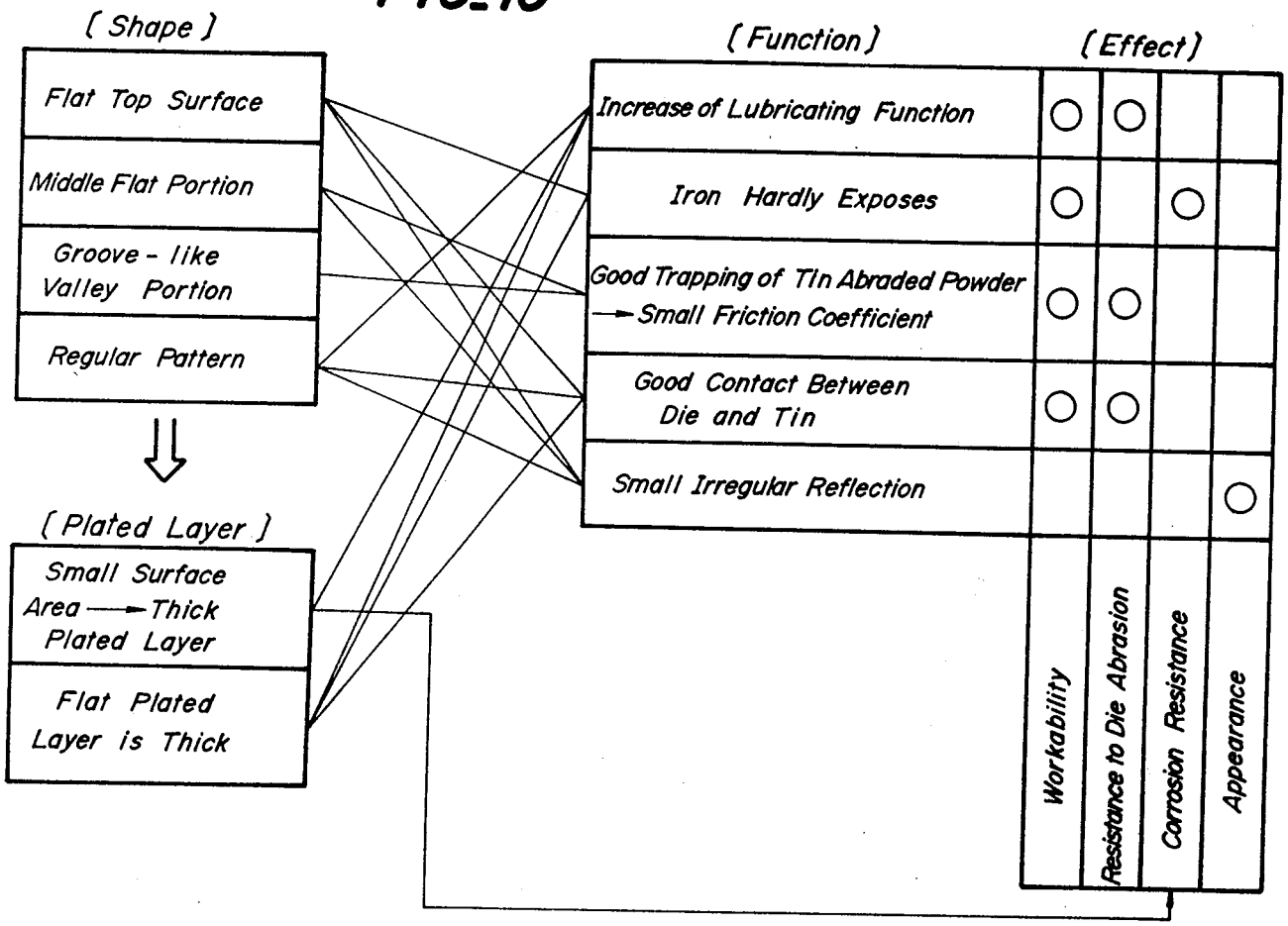
FIG. 10 is a view showing a relation among the shape of the steel sheet for DI ca according to the invention and its function and effect.

These features have a relation as shown in FIG. 10. As seen from FIG. 10, when the steel sheet for DI can according to the invention is subjected to a tinning and further to a DI work, all of corrosion resistance, resistance to die abrasion, DI workability and the like are advantageously improved.

[4] Surface profile of steel sheet for DI can after temper rolling

Figure 11:
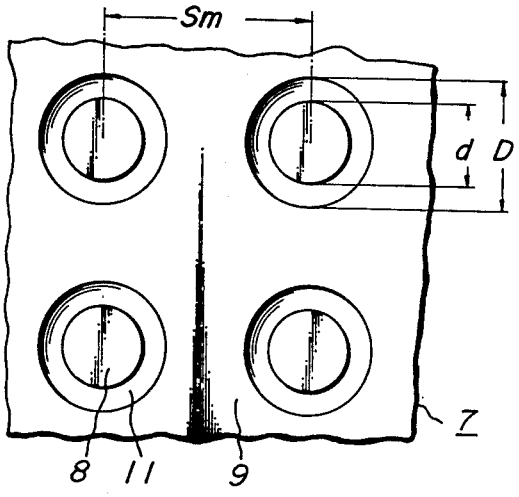
FIG. 11 is a partial plan view showing a relation among diameter in outer periphery of valley portion, diameter of top surface and mean center distance between adjoining top surfaces in the steel sheet for DI can according to the invention.

In the surface of the steel sheet 7 as shown in FIG. 11, D represents a diameter in an outer periphery of the valley portion 11, d represents a diameter of the top surface 8, and Sm represents a mean center distance between the adjoining top surfaces 8.

When $Sm/D > 1.0$, the adjoining valley portions 11 are not interfered with each other, while when $Sm/D = 1.0$, the outer peripheries of the adjoining valley portions 11 contact with each other, and when Sm/D<1.0, the adjoining valley portions 11 are mutually interfered with each other.

Figure 12:
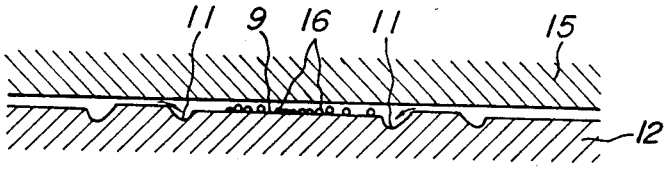
FIG. 12 is a diagrammatically section view showing a relation among diameter in outer periphery of valley portion, mean center distance between adjoining mountain top surfaces and trapping property for abraded powder.

Viewing the above from the work roll 3, the laser pulse should be projected so as to interfere the flanges 2 of the dulled work roll 3 with each other in order to achieve Sm/D<1.0, so that it is difficult to stably dull the work roll 3. Therefore, the surface profile of the steel sheet should be Sm/D≧1.0. On the other hand, when Sm/D is too large, as shown in FIG. 12, tin abraded powder 16 produced from the plated steel sheet 12 in the DI work remains between the die 15 and the flat portion 19 without being trapped in the valley portion 11 and finally the galling is caused. As a result of the inventors' experiments, it has been confirmed that the galling is frequently caused when Sm/D exceeds 1.7. From these facts, the ratio Sm/D is restricted to a range of 1.0~1.7 according to the invention.

Since the top surface 8 is subjected to a loading in the DI work, if the diameter d of the top surface 8 is too large, the galling is caused likewise the case of Sm/D>1.7. According to the inventors' experiments, it has been confirmed that the galling is apt to be caused when the diameter d exceeds 500 μm. In order to form the top surface 8 having a diameter of more than 500 μm, it is necessary to make the diameter of the crater 1 itself in the dulled work roll 3 large. In this case, energy amount required for the formation of craters 1 in the laser pulse irradiation is excessive, so that it is required to use a laser generator with a power larger than is necessary or to delay the revolution number of the roll 3 to prolong the irradiation time, which is financially unsuitable and results in the reduction of total treating efficiency and reliability. Therefore, the diameter d should be not more than 500 μm.

On the other hand, when the top surface d is too small, there is caused the degradation of corrosion resistance due to the exposure of iron (steel sheet 7) in the DI work. According to the inventors' experiments, it has been confirmed that the exposure of iron is apt to be caused when the diameter d is less than 30 μm. Further, as the diameter d becomes small, the diameter D is necessarily reduced. Therefore, in order to satisfy Sm/D≦1.7 with the reduction of the diameter d, the value of distance Sm itself should be made small, which corresponds to the reduction of distance between craters 1 in the dulled work roll 3. For this purpose, it is necessary to extremely reduce the revolution number of the roll 3 or considerably raise the frequency of laser pulse in the dulling through laser, which is financially unsuitable. From these facts, the diameter d of the top surface 8 in the mountain portion 10 should be not less than 30 μm.

[5] Center-line average surface roughness Ra of steel sheet 7

As previously mentioned, it is most important to control the microscopic profile forming the rough surface of the steel sheet 7 for DI can according to the invention. Besides, it is also important to control the surface roughness of the steel sheet 7.

That is, even when the microscopic profile of the rough surface is controlled as mentioned above, if the center-line average surface roughness Ra is less than 0.1 μm, the galling is caused in the resulting plated steel sheet for DI can, while if Ra exceeds 4.0 μm, the remarkable effect of improving the DI workability and the like is not obtained and the appearance of the can bottom is unfavorably poor. According to the invention, therefore, the center-line average surface roughness Ra of the steel sheet 7 is 0.1~4.0 μm.

The following example is given in the illustration of the invention and is not intended as limitation thereof.

EXAMPLE

An extra-low carbon steel sheet was cold rolled, continuously annealed and then temper-rolled to obtain a steel sheet (thickness: 0.34 mm) for DI can having a tempering degree of 1 (49° $H_R30$ T). As a work roll for temper rolling, there were provided rolls dulled through a laser pulse process, a shot blast process and a discharge working process, respectively, whose center-line average surface roughness Ra being a level of 4–5.

The steel sheet for DI can was subjected at both surfaces to a tinning of #25 (2.8 g/m$^2$) or #50 (5.6 g/m$^2$) to thereby form a plated steel sheet for DI can. The resulting plated steel sheet was not subjected to a reflow treatment, but it may be lightly subjected to the reflow treatment.

Then, a round sheet of a given size was punched out from the plated steel sheet and subjected to drawing and further to three-stage ironing through die so as to provide a can sidewall thickness of 0.10 mm. In this case, the can-manufacturing speed was 120 cans/min.

Figure 13:
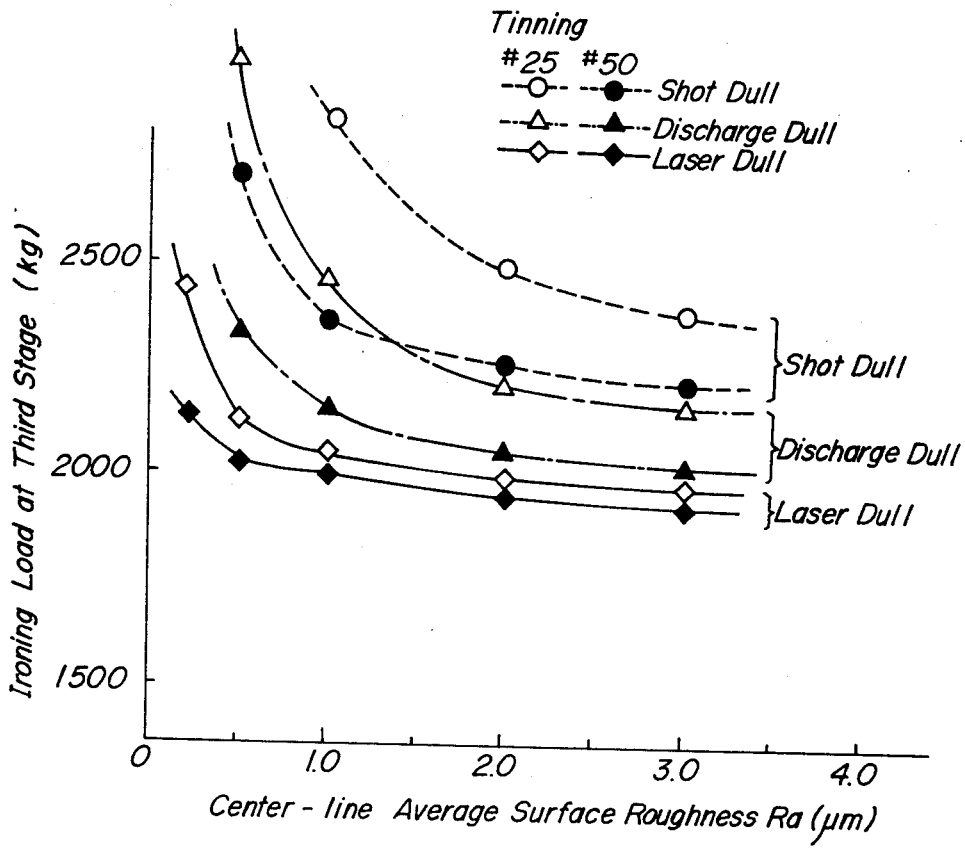
FIG. 13 is a graph showing a relation between centerline average surface roughness and ironing load in the invention and the conventional method.

A relation between the ironing load in the die at third stage and the center-line average surface roughness Ra of the plated steel sheet is shown in FIG. 13. As seen from FIG. 13, the ironing load at the third stage can be reduced in the plated steel sheet for DI can according to the invention obtained by dulling the steel sheet with the work roll dulled through laser pulse process (hereinafter referred to as laser dull simply) than in the plated steel sheets using the dulled work rolls through the conventional shot blast process and discharge working process (hereinafter referred to as shot dull or discharge dull simply) irrespective of the tinned amount. Further, the roughness for galling limit lowered to 0.1 as a center-line average surface roughness Ra.

Figure 14:
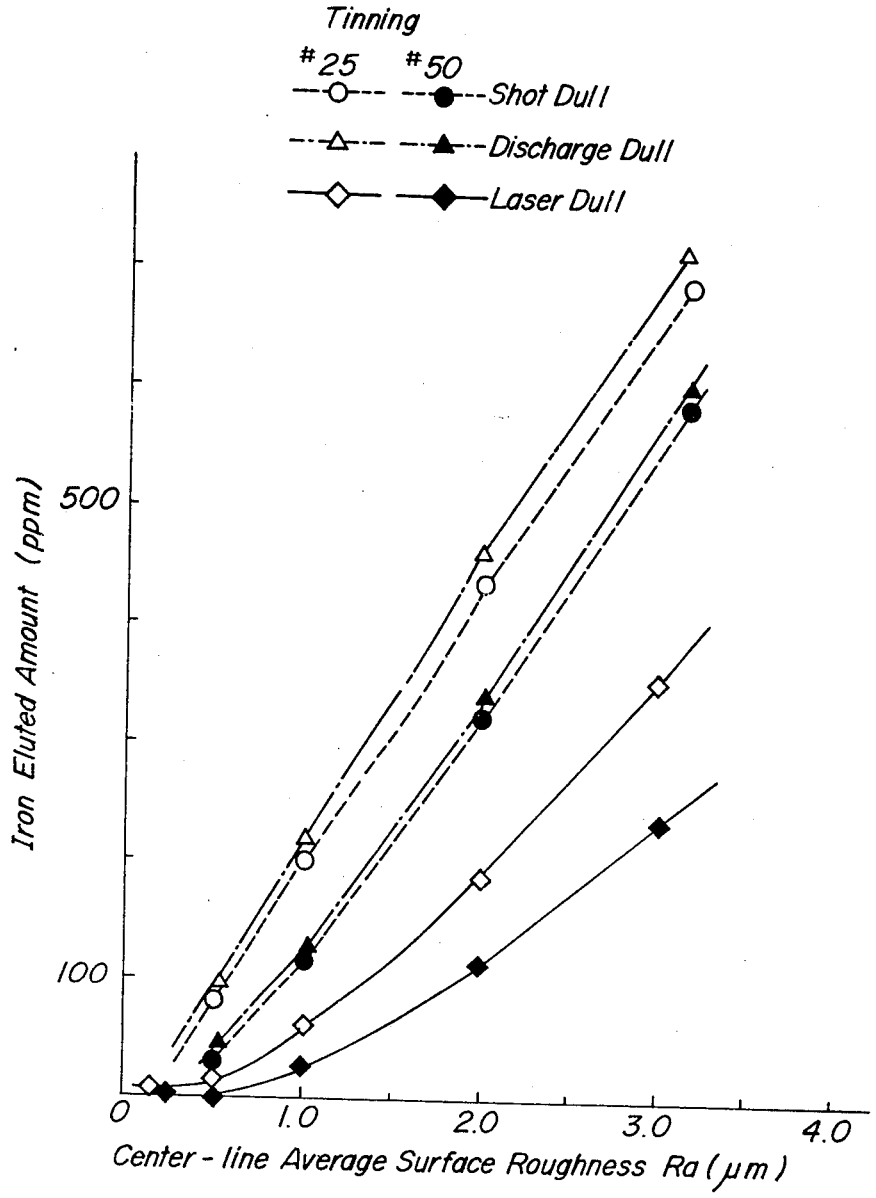
FIG. 14 is a graph showing a relation between centerline average surface roughness and iron eluted amount in the invention and the conventional method.

A specimen of 1×2 cm was cut out from each sidewall of the resulting cans and immersed in a carbonated beverage of 250 ml over five days. Thereafter, the iron amount eluted in the carbonated beverage was measured to obtain a relation between iron eluted amount and center-line average surface roughness Ra as shown in FIG. 14. As seen from FIG. 14, the laser dull steel sheet is excellent in the corrosion resistance as compared with the conventional cases. Particularly, the corrosion resistance is more improved as the roughness becomes small.

As mentioned above, the plated steel sheets for DI can using the steel sheet according to the invention are excellent in the corrosion resistance, resistance to die abrasion, DI workability, appearance at can bottom and the like even when reducing the tinned amount.

What is claimed is:

1. A steel sheet for drawing and ironing worked cans, characterized in that a center-line average surface roughness Ra of said steel sheet is within a range of 0.1~4.0 μm, and a microscopic shape constituting said surface roughness is comprised of trapezoidal mountain portions having a flat top surface, groove-like valley portions formed so as to surround a whole or a part of the mountain portion and middle flat portions formed between the mountain portions outside the valley portion so as to be higher than the bottom of the valley portion and lower than or equal to the top surface of the mountain portion and satisfies the following relations:

$1.0 \leqq Sm/D \leqq 1.7$ $30 \leqq d \leqq 500$ (μm)

, wherein Sm is a mean center distance between the adjoining mountain portions, D is a mean diameter in the outer periphery of the valley portion and d is a mean diameter in the flat top surface of the mountain portion.

* * * * *